United States Patent [19]

Molby

[11] 4,422,818

[45] Dec. 27, 1983

[54] SCRAPPER TYPE VEHICLE

[76] Inventor: Lloyd A. Molby, P.O. Box 7788, Longview, Tex. 75602

[21] Appl. No.: 408,684

[22] Filed: Aug. 16, 1982

Related U.S. Application Data

[63] Continuation of Ser. No. 162,376, Jun. 23, 1980, abandoned.

[51] Int. Cl.[3] ..... B66F 9/00

[52] U.S. Cl. ..... 414/712; 414/917

[58] Field of Search ..... 414/685, 712, 713, 706, 414/707, 710, 697, 917

[56] References Cited

U.S. PATENT DOCUMENTS 2,481,251 9/1949 Severin et al. ..... 414/712

3,291,330 12/1966 Wagner ..... 414/697

*Primary Examiner*—Joseph J. Rolla

*Assistant Examiner*—Kenneth Noland

*Attorney, Agent, or Firm*—Wofford, Fails & Zobal

[57] ABSTRACT

An improvement in scrapper type vehicle, for handling junk cars and the like, having a frame mounted on wheels and having a prime mover powering the vehicle, characterized by a pair of beams having their inner ends pivotally attached to the frame at a pair of respective first points for pivotal movement about the first transverse, horizontal axis thereat; a lifting fork pivotally attached to the main beams at their respective outer ends at a pair of respective second points and having lift prongs adapted to load the junk cars onto a transport vehicle; elevating rams connected with the main beams and the frame for elevating the junk cars; and load fork tilting rams attached to the main frame at a pair of respective third points for pivotal movement about a second transverse, horizontal axis thereat. The lift fork tilting rams are attached to the lift fork at a pair of respective fourth points. The respective first and third points are disposed vertically with respect to each other in the same respective direction that the second and fourth points are disposed with respect to each other when the lift fork prongs are neutrally tilted, or substantially horizontal such that the lift fork can be moved from ground level to maximum height with the neutral tilt maintained by only raising the outer ends of the main beams.

3 Claims, 4 Drawing Figures

SCRAPPER TYPE VEHICLE

This is a continuation of application Ser. No. 162,376, filed June 23, 1980 now abandoned.

FIELD OF THE INVENTION

This invention relates to so called scrapper type vehicles and, particular, to self-propelled, wheeled type vehicles having lifting prongs or the like attached for lifting junk cars or the like onto a transport vehicle, the lifting prongs being powered for tilting or relative pivoting movement about a transverse horizontal axis as well as being moved upwardly and downwardly for loading the junk car or the like onto the transport vehicle.

DESCRIPTION OF THE PRIOR ART

In the prior art, junk cars or the like have been mangled, shreaded, compressed, handled with electromagnet pick-ups on cranes, booms and the like. One of the problems that has compounded the crushing of the relatively thin cosmetic skin of the vehicles has been the engine or the like. Consequently, it has been part of the prior art to have engine pullers to pull the structurally strong engine out of the vehicle to allow the vehicle to be more readily handled in whatever fashion it was desired.

The inventor herein has served as a consulant in designing new approaches in which front end loaders had their bucket replaced with forklifts or similar apparatus for handling the junk cars. There have been two recurring problems that needed a solution. The first was the need to be able to load the cars to the legal height of about thirteen feet six inches in most states. The second has been the need to be able to raise the lifting fork without having the lifting fork prongs change their angle such that the car would slide downwardly off of the lifting prongs as it was being raised. The first problem has not been solved until this invention. The second problem was only partially solved, before this invention, by supplemental controls for altering the tilting angle of the lifting prongs. The supplemental controls required skilled operators who can operate, simultaneously, the elevating means for elevating the lifting prongs and the automobile as well as changing the controls to keep the tilt the same, if sufficient production was to be made; rather than erratic stop and go operation.

SUMMARY OF THE INVENTION

Accordingly, it is an object of this invention to provide a scrapper type vehicle that can alleviate the deficiencies of the prior art apparatus.

It is a specific object of this invention to provide a scrapper type vehicle that can load junk cars or the like to the legal height and that can raise the cars to the desired height when they are impaled on lifting forks without having to have two sets of controls to maintain the neutral tilt of the lifting fork to keep the cars from falling off thereof as they are lifted upwardly.

These and other objects will become apparent from the descriptive matter hereinafter, particularly when taken in conjunction with the appended drawings.

In accordance with this invention, there is provided an improvement in a scrapper type vehicle for handling junk cars and the like and having a frame mounted on wheels and having a prime mover powering the vehicle. The improvement comprises;

a. a pair of main beams attached at an inner end portion to a pair of respective first points on the frame for pivotal movement about a first transverse, horizontal axis thereat;

b. a lifting fork means pivotally attached to the main beams at their respective outer ends at a pair of respective second points and having lift prongs adapted to penetrate laterally through the junk cars to lift the junk cars and to load the junk cars onto a transport vehicle;

c. elevating means connected with the main beams and the frame for elevating the outer ends of the main beams and the lifting fork means with any junk car thereon;

d. lift fork tilting means attached to the frame at a pair of respective third points for pivotal movement about a second transverse, horizontal axis thereat; the lifting fork tilting means being pivotally attached to the lifting fork means at a pair of respective fourth points; the lifting fork tilting means including extensible and retractable means that can be locked into a given length for fixing an angle of tilt such as a neutral angle, to the lifting fork means; the pairs of first and third points being disposed vertically with respect to each other and at the same angle and in the same respective direction that the pairs of second and fourth points are disposed to each other when the lift fork prongs are substantially horizontal such that the lift fork means can be moved from ground level to maximum height with a neutral tilt maintained by only raising the outer ends of the beams.

By neutral tilt is meant when the lifting prongs are substantially horizontal, as for passing through the windows of a junk car or the like.

DESCRIPTION OF THE PREFERRED EMBODIMENTS

Figure 1:
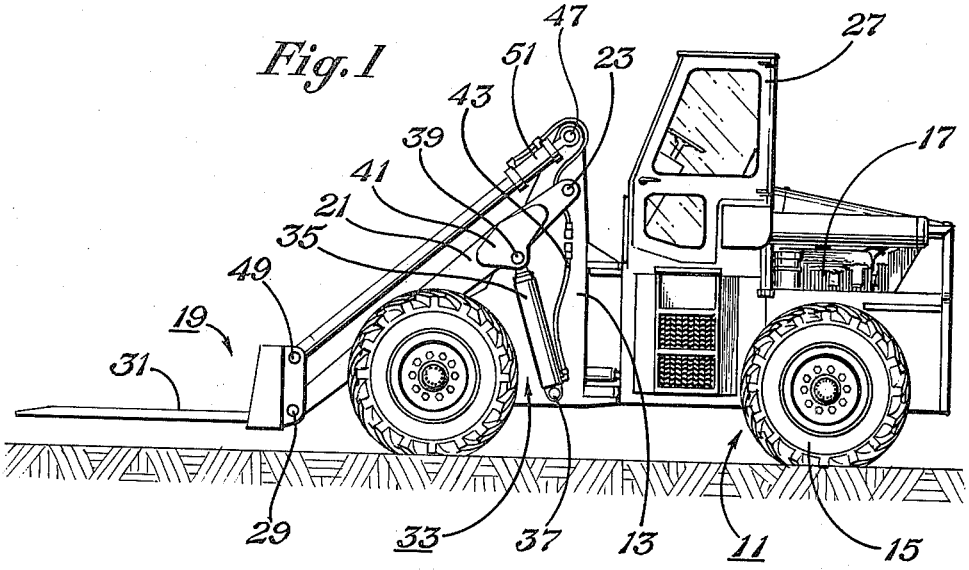
FIG. 1 is side elevational view of the scrapper vehicle in accordance with one embodiment of this invention.

This invention can be understood by referring to the Figs. In FIG. 1, the scrapper type vehicle 11 has its frame 13 mounted on wheels 15 and a primer mover 17 is mounted on the opposite end of the vehicle 11 from the lift fork means 19.

A variety of different types of vehicles 11 with different types of frames 13 can be employed. As illustrated, the vehicle 11 is an articulating vehicle that steers by pivotal movement, responsive to hydraulic rams, about a vertical axis formed by pins through suitable hinge, or steering, brackets. The plurality of wheels 15 may comprise 3 or more to impart stability. As illustrated, there are four wheels having large rubber tires. The prime mover 17 may be an internal combustion engine. It develops the power required for locomotion as well as to operate the various accessories, such as hydraulic pumps (not shown). The locomotion may be from hydrostatic system in which the prime mover drives a main pump and in which respective wheels are powered by hydraulically operable motors. On the other hand, electric generator-motor drive combinations may be employed if desired.

In accordance with this invention, the lift fork means 19 is moved through an arc by at least one main beam 21. Preferably there are a pair of main beams 21 that are pivotally attached at their inner end portions to a pair of respective first points, or shafts, 23 for pivotal movement about a first transverse horizontal axis thereat. The main beams 21 are formed of metal, such as steel, and are structurally adequate to bear the load of the lifting fork means 19 and any junk car or the like that is emplaced thereon such that the junk car can be lifted to the legal height and loaded onto a transport vehicle. To this end, the first points, or shafts, 23 are located at sufficient height above the ground to enable elevating the car to as high as thirteen feet six inches, or the legal limit. As illustrated, the shafts 23 are located about 12–15 feet above the ground; and, preferably, about 14 feet above the ground. This represents a good compromise that allows attaining the legal height without having to have unduly long main beams 21 that makes for a cumbersome vehicle.

The operator then sits in a cab, or console, 27 so as to be able to see over the frame with the relatively high point of attachment. In the operator's console 27 there are provided the respective controls for the vehicle as well as the hydraulic ram controls noted hereinafter for operating the elevating means and the tilting means controlling the lift fork means 19.

The lift fork means 19 is pivotally attached to the main beams at their respective outer ends at a pair of respective second points, or pivot shafts, 29. The respective second pivots shafts are transversely located with respect to each other so as to define a transverse horizontal axis for tilting of the lift fork means thereabout. The lifting fork means has lift prongs 31 adapted to penetrate laterally through junk cars or the like to lift the junk cars and to load the junk cars onto a vehicle. As illustrated, a pair of lift prongs 31 are employed. The lift prongs are made of suitably strong material for penetrating through the junk cars or the like. Ordinarily, the lift prongs may be inserted through window openings in the junk car but should have adequate strength to penetrate through the thin metal doors or the like if necessary. As illustrated, the lift prongs are formed of steel members although other metallic types of construction may be employed. It is vital, however, that the lift prongs maintain the junk car in position to prevent its falling off of the lift prongs as the junk car is raised by an elevating means 33.

Figure 2:
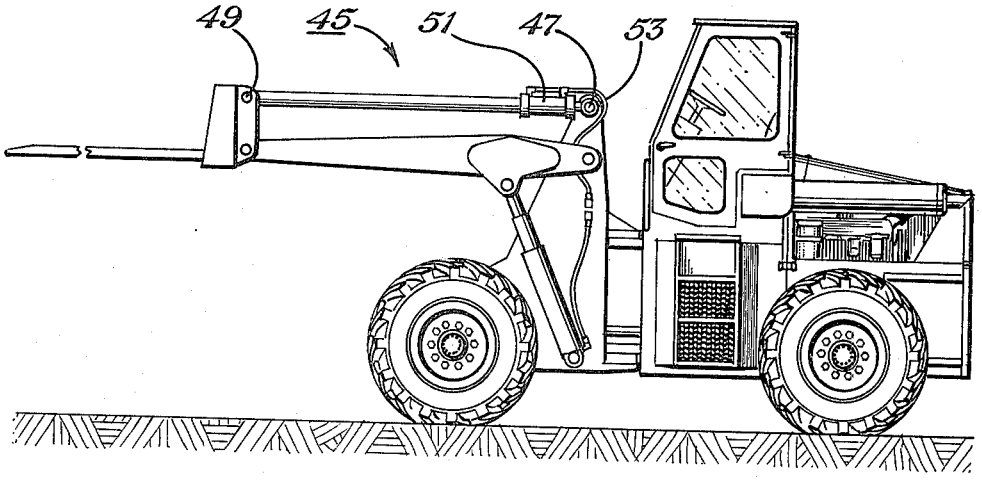
FIG. 2 is a side elevational view of the scrapper type vehicle showing the opposite side and with the lifting prongs midway in the raised position and still with a neutral tilt.

The elevating means 33 is connected with the main beams 21 and the frame 13 for elevating the outer ends of the main beams and the lifting fork means with any junk car thereon. As illustrated, the elevating means 33 comprises a pair of hydraulic rams 35 that are connected, respectively, as by pivot shafts 37, 39, with the frame and the main beam 21. A lifting pad 41 is provided on the main beam 21 for added strength and to facilitate attachment with the cylinder rod of the hydraulic ram 35. The hydraulic ram is powered by hydraulic fluid, as by way of hoses 43. As illustrated, one hydraulic ram 35 is connected with each of the main beams for providing substantially uniform lift responsive to power from the hydraulic pump controlled by hydraulic controls in the operator's console. It is desirable that the lifting means be able to raise the outer ends of the main beams without significantly altering the tilt effected by tilting means 45, FIG. 2.

Figure 4:
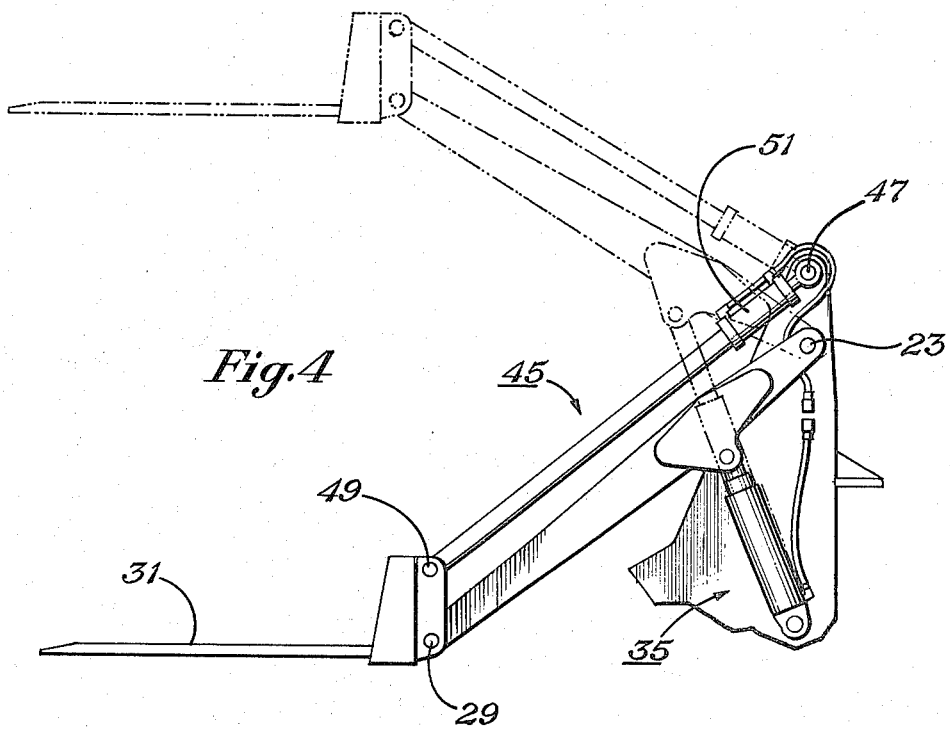
FIG. 4 is a schematic view showing the elevating of the lifting prongs without changing their angle of tilt from neutral.

The lift fork tilting means 45 are attached to the frame at a pair of respective third points, or pivot shafts, 47 for pivotal movement about a second transverse, horizontal axis thereat. The lifting fork tilting means is pivotally attached to the lift fork means at a pair of respective fourth points, or pivot shafts, 49. The lift fork tilting means includes extensible and retractable means that can be locked into a given length for fixing an angle of tilt to the lift prongs of the lift fork means. As illustrated, the extensible and retractable means comprises respective hydraulic rams 51. Each hydraulic ram 51 is powered by high pressure hydraulic fluid supplied, as by hoses 53 from the controls in the operator's console 27. The high pressure hydraulic fluid is powered by suitable pumps (not shown). Preferably, lock valves are employed to maintain the hydraulic rams 51 in a preset length configuration, such as that attaining neutral tilt on the lift fork prongs 31. Specifically, the lift fork tilting means comprise a pair of lineal members coextensive with the main beams 21 and incorporating the hydraulic ram 51 as a part of their length. Thus, when the hydraulic ram 51 is extended, the tilt of the prong 31, FIG. 4, is moved downwardly to facilitate sliding off the prongs any load or the like. Conversely, retraction of the hydraulic ram 51 shortens the tilt means and effects an upward tilt of the prongs 31. As illustrated in FIG. 4, the prongs 31 frequently are given a substantially neutral tilt with prongs substantially horizontal for loading.

Figure 3:
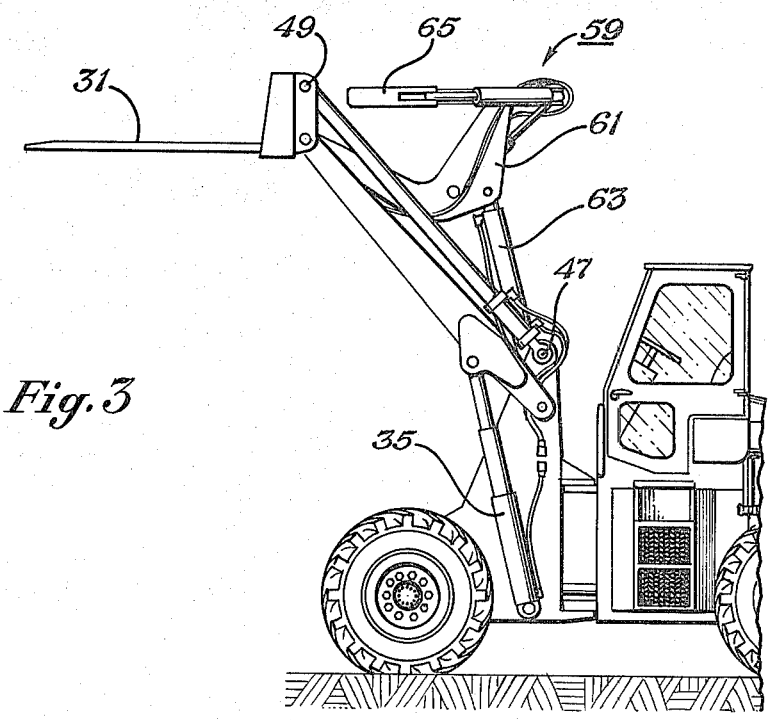
FIG. 3 is a side elevational view of the scrapper type vehicle of FIG. 1 with an engine puller installed and with the lifting fork prongs in the neutral tilt at the full uppermost position.

As can be seen in FIG. 3, the prongs 31 can be elevated to their top position and maintain the neutral tilt by simply extending the hydraulic ram 35 to raise the outer most ends of the main beams 21.

In operation, the scrapper type vehicle is assembled as illustrated and described hereinbefore. The operator may tilt the lift prongs 31 to neutral position and insert them appropriately for lifting of a junk car or the like. For example, the lift prongs can be inserted beneath the junk car; can be inserted through the window of the junk car, whether or not it is wrecked, crushed or otherwise altered from its normal appearance; or can be even inserted through the thin metal side walls of doors and the like if necessary. Thereafter, the elevating means 33 is operated to raise the junk car to a desired height, as for stacking on a transport vehicle, such as a flatbed truck or the like. The junk car is deposited. The elevating means is lowered if necessary to lower the lifting prongs 31 sufficiently to take the weight from them and to remove them from the junk car. The scrapper type vehicle is backed up and moved to pick up another junk car for stacking and the cycle is repeated. As long as the lifting prongs 31 remain in about the neutral position, all that is necessary is to operate the hydraulic ram 35 serving as a significant portion of the elevating means to raise and lower the prongs to raise the junk cars for loading.

Even when the tilting prongs are tilted slightly, substantially the same angle of tilt is maintained when raised or lowered because the combination of the vertically spaced first and third points and the substantially vertically spaced second and fourth points approach a parallelogram linkage that does not sacrifice strength and flexibility, yet enables raising the lifting prongs without significantly changing the angle of tilt. More-over, the first points, or pivot shafts 23 are emplaced high enough that the junk cars can be stacked to the legal height on a transport vehicle.

One of the advantages of this invention is that it provided an exceptionally flexible vehicle to which can be attached a variety of accessories or the like. For example, a bucket can be attached instead of the lifting fork means to enable the operator to scoop up broken glass, damaged chrome parts and the like that may fall from the junk cars as they are being loaded. On the other hand, blades; such as, dozer blades and the like; can be attached for minor grading. These are usually attached to the main beams and to the tilting means 45 such that the same controls can be employed.

In addition, accessories such as an engine puller 59, FIG. 3, can be attached. As illustrated, the engine puller 59 is pivotally mounted intermediate the main beams 21 and has a psuedo bell crank portion 61 that is pivotally connected with a hydraulic ram 63. The hydraulic ram can then be operated from controls (not shown) in the operator's console to effect tilting movement of the engine puller. The engine puller is conventional and need not be described in detail. It is sufficient to note that it has a pair of jaws 65 that can reach into the engine compartment and literally pull an engine or engine and transmission from a car in a few seconds; in contrast to the two hours or more that the operation formerly took. The engine can then be deposited at a suitable point; such as, in the junk metal bin, parts bin, or the like.

From the foregoing, it can be seen that this invention provides the objects delineated hereinbefore.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter being had to the appended claims.

I claim:

1. In a scrapper type vehicle for handling junk cars and the like and having a frame mounted on wheels and having a prime mover powering the vehicle, the improvement comprising:

a. a pair of main beams attached at respective inner end portions to a pair of respective first points on said frame for pivotal movement about a first transverse, horizontal axis thereat;

b. a lifting fork means pivotally attached to said main beams at their respective outer ends at a pair of respective second points and having lift prongs adapted to penetrate laterally through said junk cars to lift said junk cars and to load said junk cars onto a transport vehicle;

c. elevating means connected with said main beams and said frame for elevating said outer ends of said main beams and said lift prongs with any junk car thereon; and d. lift fork tilting means attached to said frame at a pair of respective third points for pivotal movement about a second transverse, horizontal axis thereat; said lift fork tilting means being pivotally attached to said lift fork means at a pair of respective fourth points; said lift fork tilting means including extensible and retractable means that can be locked into a given length for fixing an angle of tilt to said lift fork means, that said lift fork tilting means can be locked into a parallelogram linkage with said main beams with said lifting fork means at neutral tilt and that said lift fork tilting means can be varied into trapezoidal configurations with said main beams at other angles of tilt of said lifting fork means when positioned either upward or downward from the neutral tilt;

said pair of first and third points being disposed vertically with respect to each other and at the same angle and in the same respective direction that said pairs of said second and fourth points are disposed with respect to each other when said lift fork prongs are substantially horizontal in said neutral tilt such that said lift fork means can be moved from ground level to maximum height with the neutral tilt maintained by only raising said outer ends of said main beams because of said parallelogram linkage at said neutral tilt.

2. The scrapper type vehicle of claim 1 wherein said main beams are connected at said first points sufficiently high and are sufficiently long that junk cars can be loaded to the legal height limit with said lift prongs through windows of said vehicles when said main beams are at the full upper limit of travel of their respective outer ends.

3. The scrapper type vehicle of claim 2 wherein there is included a hydraulic pump that is powered on said vehicle to put out high pressure hydraulic fluid, a control console is connected with an operators console on said vehicle for routing said high pressure hydraulic fluid for control of hydraulic rams; said extensible and retractable means comprise a pair of hydraulic rams and a pair of elongate beams for setting the desired tilt; and said elevating means comprises two hydraulically powered rams at respective fifth laterally disposed points and connected with said main beams intermediate its ends and powered by high pressure hydraulic fluid from said pump via said controls and via hoses.

* * * * *